US008435092B1

(12) United States Patent
Smith

(10) Patent No.: US 8,435,092 B1
(45) Date of Patent: May 7, 2013

(54) PERSONAL WATER SPORT RIDING BOARD

(76) Inventor: Ronald G. Smith, Dallas, GA (US)

( * ) Notice: Subject to any disclaimer, the term of this patent is extended or adjusted under 35 U.S.C. 154(b) by 138 days.

(21) Appl. No.: 12/982,203

(22) Filed: Dec. 30, 2010

Related U.S. Application Data

(60) Provisional application No. 61/291,043, filed on Dec. 30, 2009.

(51) Int. Cl.
*B63B 1/00* (2006.01)

(52) U.S. Cl.
USPC ..... 441/65; 441/79

(58) Field of Classification Search ..... 441/65, 441/79
See application file for complete search history.

(56) References Cited

U.S. PATENT DOCUMENTS

| | | | | | |
|---|---|---|---|---|---|
| 3,063,071 | A | * | 11/1962 | Van Vorst | 441/77 |
| 3,211,126 | A | * | 10/1965 | Bowlus | 440/14 |
| 3,599,259 | A | * | 8/1971 | Shewmon | 441/70 |
| 3,761,980 | A | * | 10/1973 | Silverstein | 441/68 |
| 4,321,048 | A | | 3/1982 | Marchese et al. | |
| 4,389,195 | A | | 6/1983 | Sohaei | |
| 4,708,675 | A | | 11/1987 | Shoeffler et al. | |
| 4,804,347 | A | | 2/1989 | Ross | |
| 5,052,963 | A | * | 10/1991 | Johnson, III | 441/68 |
| D346,193 | S | | 4/1994 | Bryce | |
| D349,935 | S | | 8/1994 | Simonson | |
| 5,462,001 | A | * | 10/1995 | Lemelson | 114/253 |
| D461,516 | S | | 8/2002 | Chen | |
| 6,579,134 | B1 | | 6/2003 | Fiebing | |
| D528,166 | S | | 9/2006 | Wright | |
| D528,179 | S | | 9/2006 | Stagnaro | |
| D568,429 | S | | 5/2008 | Takayama et al. | |
| D570,945 | S | | 6/2008 | Stagnaro | |
| 2007/0051775 | A1 | | 3/2007 | Lei | |

* cited by examiner

*Primary Examiner* — Stephen Avila
(74) *Attorney, Agent, or Firm* — Montgomery Patent & Design; Robert C. Montgomery

(57) ABSTRACT

A personal water sport riding board with a modified bottom surface to enhance its water riding characteristics is herein disclosed is provided with a pair of appendages designed to facilitate the catching of water. In such a manner, as water passes on the bottom surface, it is caught by the appendages thus propelling the riding board forward in a faster manner. The appendages are manufactured of rigid foam that is covered with a fabric material in much the same manner as a conventional riding board.

18 Claims, 8 Drawing Sheets

PERSONAL WATER SPORT RIDING BOARD

RELATED APPLICATIONS

The present invention was first described in and claims the benefit of U.S. Provisional Application No. 61/291,043 filed Dec. 30, 2009, the entire disclosures of which are incorporated herein by reference.

FIELD OF THE INVENTION

The present invention relates generally to a personal water sport riding board construction, and in particular, to a personal water sport riding board with a downwardly extending fin assembly.

BACKGROUND OF THE INVENTION

One (1) of the most popular warm weather tourist destinations and activities is that of spending a warm day at the beach. Among the many activities that one can partake in at the beach, swimming and surfing are particularly popular. Over the years, there have been several new variations added to the surfing experience. One (1) of these variations is commonly called body boarding or boogie boarding in which a person lies down on their stomach on a small thin board and rides the wave into shore.

In addition to their conventional stomach-down use, body boards can be used for skimming along shallow water near a shoreline in order to run with the board and jump upon it to surf at the last minute. Such activities require a basic, but non-trivial, amount of balance and physical coordination. However, due to the fact that body boards appeal to a more general and casual crowd than surfing, many persons utilizing these boards are not as experienced or skilled as the average surfer. As a result, many persons utilizing these boards do not experience their full entertainment potential, or have trouble getting the boards to function at all.

Various attempts have been made to provide water sport boards with shapes or protrusions which affect the efficacy or operation of the board. Examples of these attempts can be seen by reference to several U.S. patents. U.S. Pat. No. 4,321,048, issued in the name of Marchese et al, describes a water board with a mechanized screw propeller which generates thrust in order to propel a user. The propeller is actuated using a hand lever located along both sides of the board.

U.S. Pat. No. 4,389,195, issued in the name of Sohaei, describes a steerable surfboard including a plurality of rudders located along a bottom surface of the board which are manually operable by a user.

U.S. Pat. No. 4,804,347, issued in the name of Ross, describes a method and structure for permanently installing fins to an underside of a surfboard.

Additionally, ornamental designs for a surfboard exist, particularly U.S. Pat. Nos. D 349,935; D 461,516; D 528,166; D 528,179; D 568,429; and D 570,945. However, none of these designs are similar to the present invention.

While these devices fulfill their respective, particular objectives, each of these references suffer from one (1) or more of the aforementioned disadvantages. Many such devices are not adapted for body boarding activities. Also, many such devices are more complicated to use than a conventional body board as they require additional activity on the part of the user during use. Furthermore, many such devices include complex mechanism which add cost and make the devices more difficult to transport. Accordingly, there exists a need for a water sport board without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a simple water sport board particularly adapted for casual body board activities which provides additional stabilization and propulsion to a user without requiring additional activity or coordination on the part of the user. Thus, the object of the present invention is to solve the aforementioned disadvantages and provide for this need.

To achieve the above objectives, it is an object of the present invention to comprise a personal water sport riding board with an enhanced bottom surface which enables the device to be propelled forward by turbulent water during use.

Another object of the present invention is to provide expected features of a water sport board including a flat board construction, a buoyant hydrodynamic core, and a smooth and waterproof exterior surface.

Yet still another object of the present invention is to create a surface area along the bottom surface of the device which allows turbulent water to forcefully strike the device such that it propels the device in a forward manner. According to a preferred embodiment, the device comprises an upper fin and a lower fin integrally molded to the core along the bottom surface. Each fin comprises a wave-shape profile including a curl which provides an indentation for the water to strike the fin.

Yet still another object of the present invention is to comprise a first alternate embodiment including a dual fin deck which includes a pair of dual fin curls integrally molded to the core along the bottom surface. Each dual fin curl comprises a "V"-shaped body which provides a pair of indentations which allow turbulent water to forcefully strike the device such that it propels the device in a forward manner.

Yet still another object of the present invention is to comprise a second alternate embodiment including a hinging fin which is connected to the bottom surface of the device with a hinge. The hinging fin is further attached to the bottom surface at a distal end with a pair of stabilizing cords. The hinging fin rotates about the hinge to a perpendicular orientation which allows turbulent water to forcefully strike the device and propel it in a forward manner. The stabilizing cords prevent the hinging fin from deploying past a perpendicular position such that water flowing in a backward direction along the bottom surface of the device collapses the hinging fin and does not propel the device in a rearward manner.

Yet still another object of the present invention is to provide a method of utilizing the preferred embodiment of the device that provides a unique means of acquiring the device; positioning the device onto a desired body of water with the bottom surface and fins in the water; positioning a rider parallel with the deck and allowing the rider to lie upon the device; allowing the rider to paddle to a desired area where waves are breaking and creating turbulent water; enabling the fins to catch the turbulent water within the curls and propel the device forward; utilizing the device in a conventional manner; and, moving faster in the turbulent water and with more control.

Yet still another object of the present invention is to provide a method of utilizing the first alternate embodiment of the device that provides a unique means of acquiring the alternate dual fin embodiment; positioning the device into a desired body of water; positioning a rider on the device; enabling the dual fins to catch the turbulent water within the dual fin curls to propel the device forward; utilizing the alternate dual fin embodiment in a conventional manner; and, moving faster in the water and with more control.

Yet still another object of the present invention is to provide a method of utilizing the second alternate embodiment of the device that provides a unique means of acquiring the alternate hinging embodiment; positioning the device onto a desired body of water; positioning a rider on the device; paddling to a location within the water where waves are breaking and enabling the hinging fin to catch turbulent water which rotates the hinging fin and extends each hinge stabilizer to propel the device forward; utilizing the alternate hinging embodiment in a conventional manner; and, moving faster in the water and with more control.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
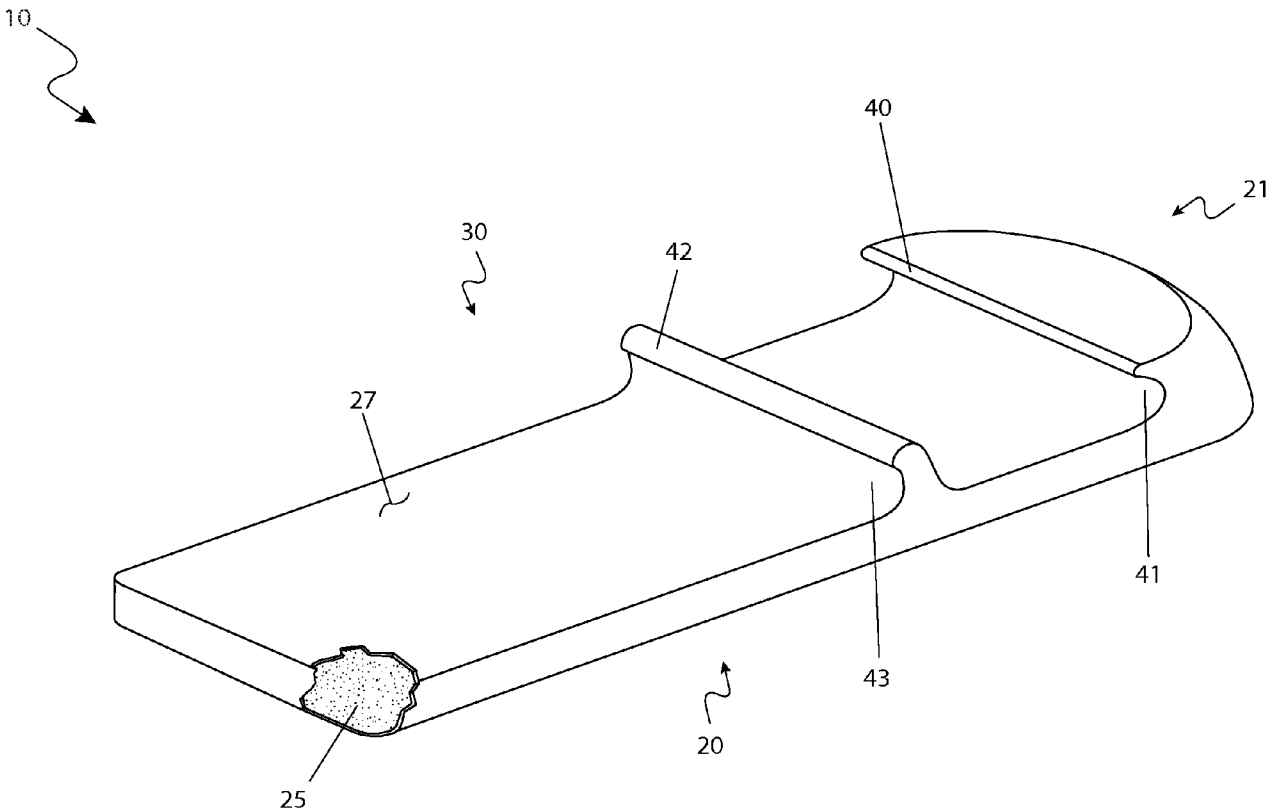
FIG. 1 is a bottom perspective view of a personal water sport riding board 10, according to a preferred embodiment of the present invention.

10 personal water sport riding board
20 deck
21 nose portion
25 core
27 exterior
30 bottom surface
40 upper fin
41 upper curl
42 lower fin
43 lower curl
50 alternate dual fin embodiment
51 alternate dual fin deck
52 alternate dual fin bottom surface
53 alternate dual fin exterior
54 upper dual fin
55 upper dual fin curl
56 lower dual fin
57 lower dual curl
60 alternate hinging embodiment
61 hinge embodiment deck
62 hinge embodiment bottom surface
63 hinge embodiment exterior surface
64 hinge embodiment core
65 hinging fin
66 stabilizing cord
67 crimp
68 hinge
69 stud
90 rider
95 turbulent water

DETAILED DESCRIPTION OF THE PREFERRED EMBODIMENT

Figure 2:
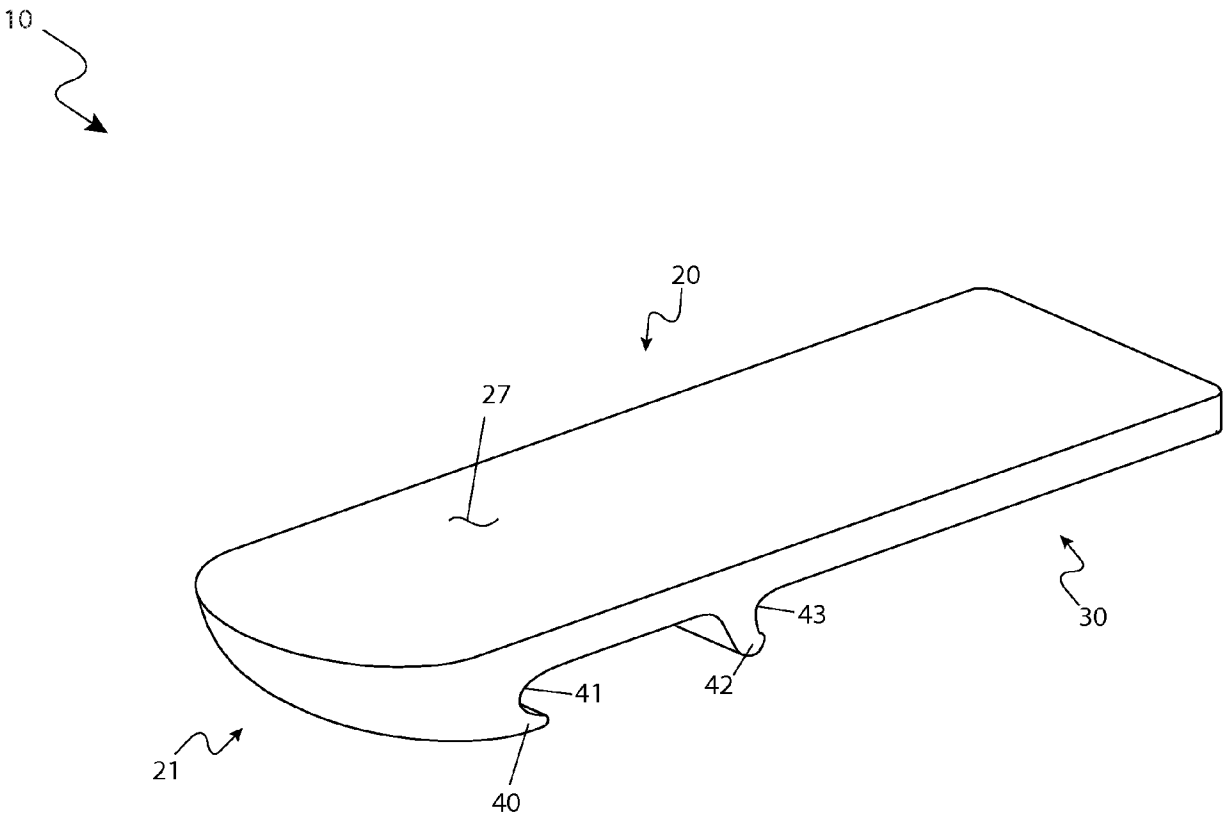
FIG. 2 is a top perspective view of the personal water sport riding board 10, according to a preferred embodiment of the present invention.
Figure 3:
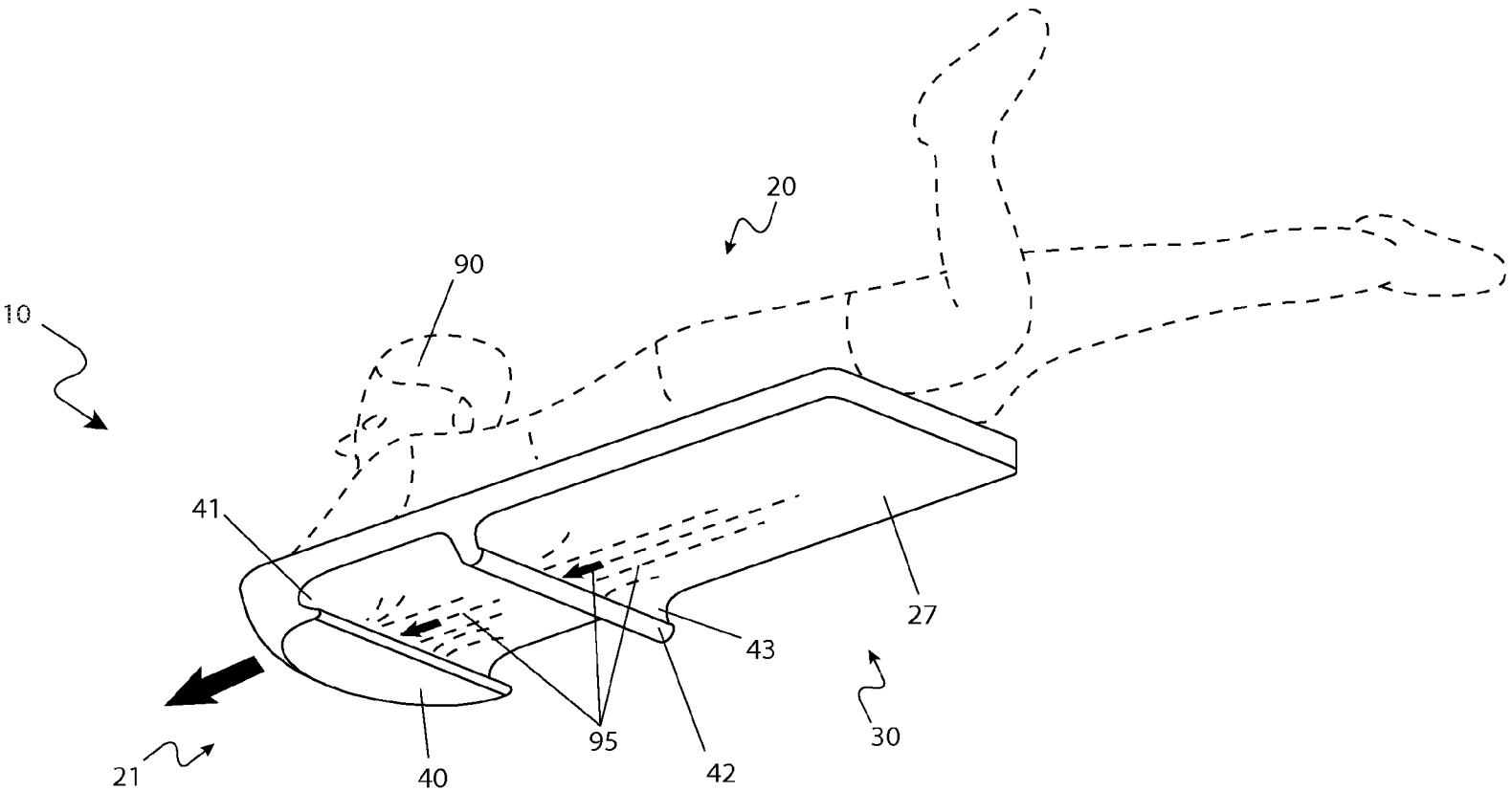
FIG. 3 is an environmental view of the personal water sport riding board 10, according to a preferred embodiment of the present invention.

The best mode for carrying out the invention is presented in terms of its preferred embodiment, herein depicted within FIGS. 1 through 3 and alternately within FIGS. 5 through 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a personal water sport riding board (herein described as the "device") 10, which provides a means for a water board, boogie board, or body board with enhanced features. The enhanced features enable the device 10 to be propelled in a forward direction by turbulent water 95. The device 10 allows a user to maneuver through a body of water in a quicker manner.

Referring now to FIG. 1, a bottom perspective view the device 10 and FIG. 2, a top perspective view of the device 10, according to the preferred embodiment of the present invention, are disclosed. The device 10 comprises a tombstone-shape formed from a core 25 which is shaved or molded to the desired tombstone-shape, yet other shapes may be utilized without limiting the features of the device 10. The core 25 is comprised of a hydrodynamic material such as foam which provides a buoyancy to the rider 90, yet other materials with various flexibility or rigidity characteristic may be utilized which may dependant upon the temperature of the water the device 10 is utilized in without limiting the scope of said device 10. The exterior 27 of the core 25 may be covered with materials such as nylon, bonded with materials such as plastic, or coated with materials such as paint. The exterior 27 may offer not only an aesthetically pleasing dynamic, but may also provide the rider 90 with additional comfort, strength, and speed as would be contingent upon the material utilized. The deck 20 or top surface of the device 10 offers an area for placement of indicia as desired by the manufacturer and provides the riding area for the rider 90 to position themselves. A bottom surface 30 comprises an upper fin 40 and a lower fin 42 which provide the abovementioned enhanced features to drive the device 10 by the turbulent water 95 (also see FIG. 3). The fins 40, 42 are preferably integrally molded to the core 25, yet may also be bonded onto the bottom surface 30 with common adhesives. Each fin 40, 42 is positioned widthwise in a parallel manner across the bottom surface 30 with the upper fin 40 positioned at the nose portion 21 of the device 10 and the lower fin 42 positioned at an intermediate location, yet other layouts may be utilized without limiting the scope of the device 10.

Referring now to FIG. 3, an environmental view of the device 10, according to the preferred embodiment of the present invention, is disclosed. In use, the rider 90 positions their torso portion upon the deck 20 with the head of said rider 90 adjacent to a nose portion 21 which arranges said rider 90 parallel with said device 10. A bottom surface 30 of the device 10 is positioned superjacent to the body of water in a conventional manner. The device 10 is paddled out to where waves are breaking to create the turbulent water 95 in the desired body of water with the nose portion 21 pointed toward the desired end location such as a beach.

The upper fin 40 and lower fin 42 upon the bottom surface 30 comprise a wave-shape and further comprise an upper curl 41 and a lower curl 43, respectively. The upper curl 41 and the lower curl 43 each curl rearwardly, which enable the turbulent water 95 to drive the device 10 forwardly. The curls 41, 43 create an indentation on the respective fin 40, 42 which create a surface area for turbulent water 95 to forcefully strike and propel the device 10. Although the device 10 is depicted as comprising a pair of fins 40, 42 it is known that at least one (1) and up to a plurality of fins 40, 42 may be utilized without limiting the scope of the device 10.

Figure 4:
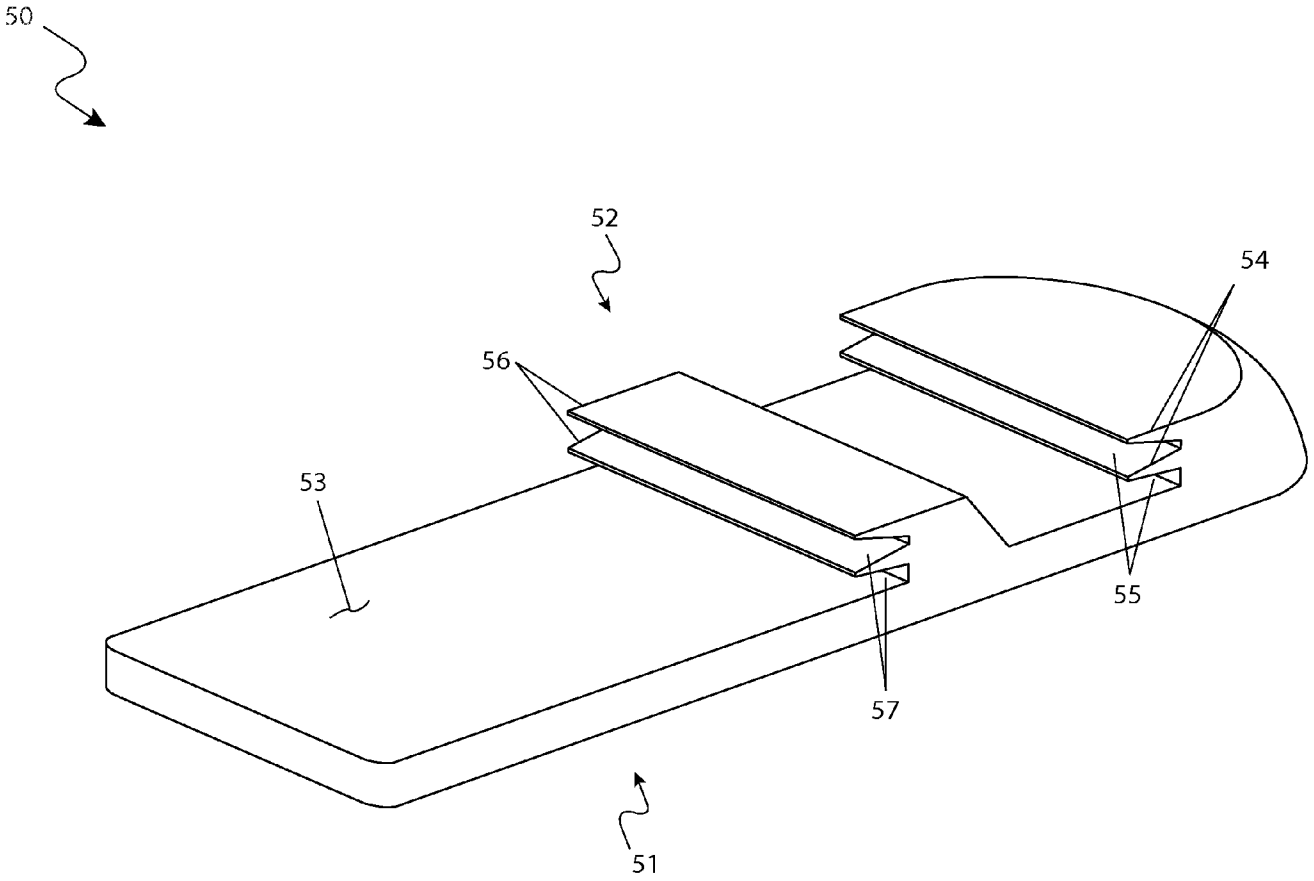
FIG. 4 is a bottom perspective view of an alternate dual fin embodiment 50, according to an alternate embodiment of the present invention.
Figure 5:
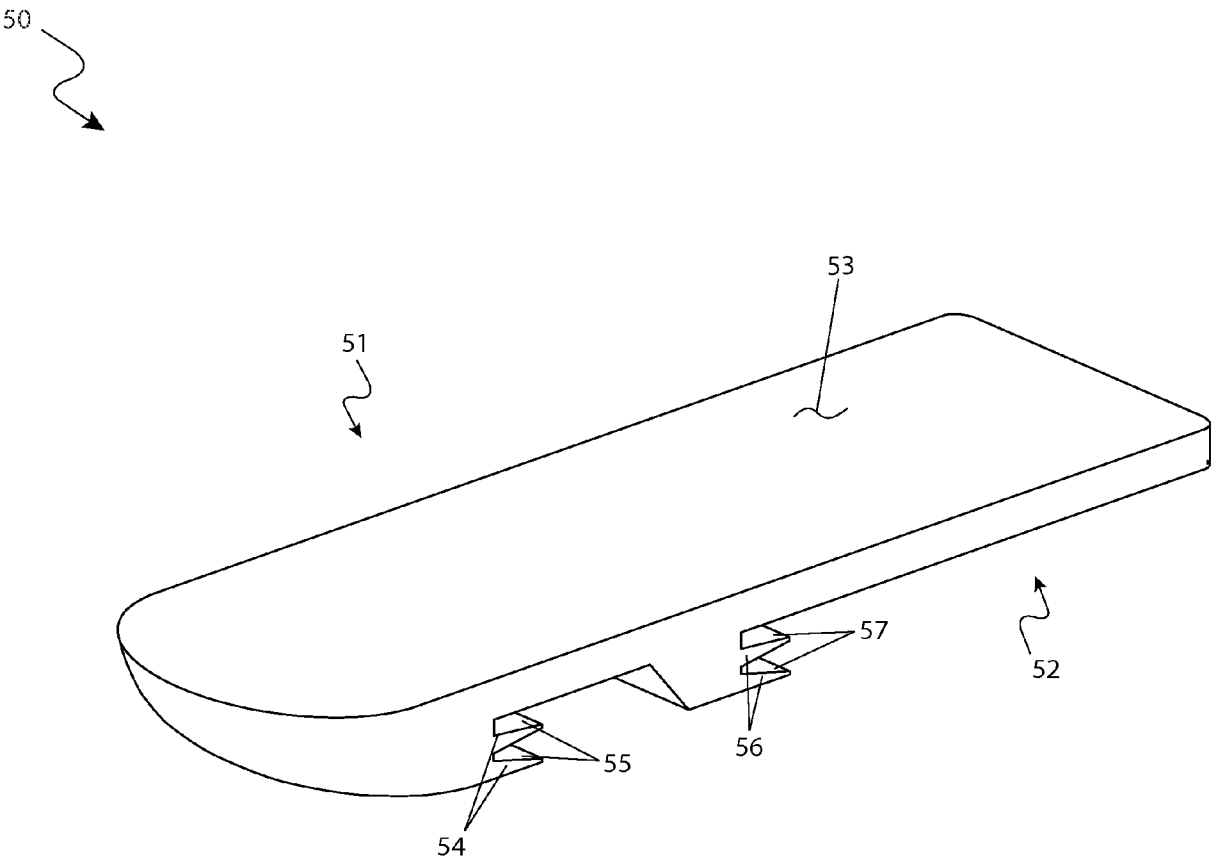
FIG. 5 is a top perspective view of the alternate dual fin embodiment 50, according to an alternate embodiment of the present invention.

Referring now to FIG. 4, a bottom perspective view of an alternate dual fin embodiment 50 and FIG. 5, a top perspective view of the alternate dual fin embodiment 50, according to the preferred embodiment of the present invention, are disclosed. FIGS. 4 and 5 depict an alternate dual fin embodiment 50 which comprises an alternate dual fin deck 51 which is utilized by the rider 90 during use similar to abovementioned deck 20. The alternate dual fin embodiment 50 also comprises an upper dual fin 54 and a lower dual fin 56. Each dual fin 54, 56 are positioned on an alternate dual fin bottom surface 52 and each comprise a horizontal "V"-shaped body which provides for a pair of dual fin curls 55, 57 to create similar features to the abovementioned preferred fins 40, 42, yet offering additional surface area for turbulent water 95 to drive the alternate dual fin embodiment 50. The dual fins 54, 56, alternate dual deck 51, and alternate bottom surface 52 would be covered or coating with an alternate dual fin exterior 53 which provide features similar to the abovementioned exterior 27. The alternate dual fin embodiment 50 is fabricated from similar materials as the preferred embodiment 10.

Figure 6:
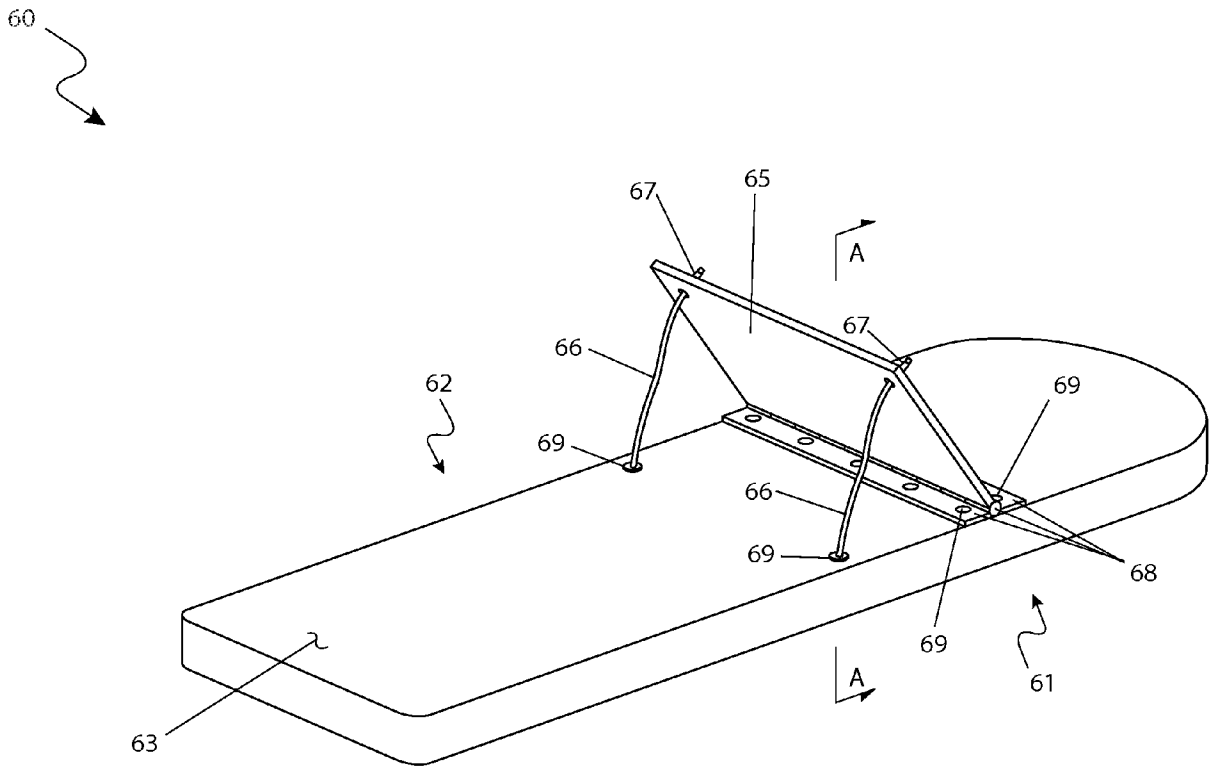
FIG. 6 is a bottom perspective view of an alternate hinging embodiment 60, according to yet another alternate embodiment of the present invention.
Figure 7:
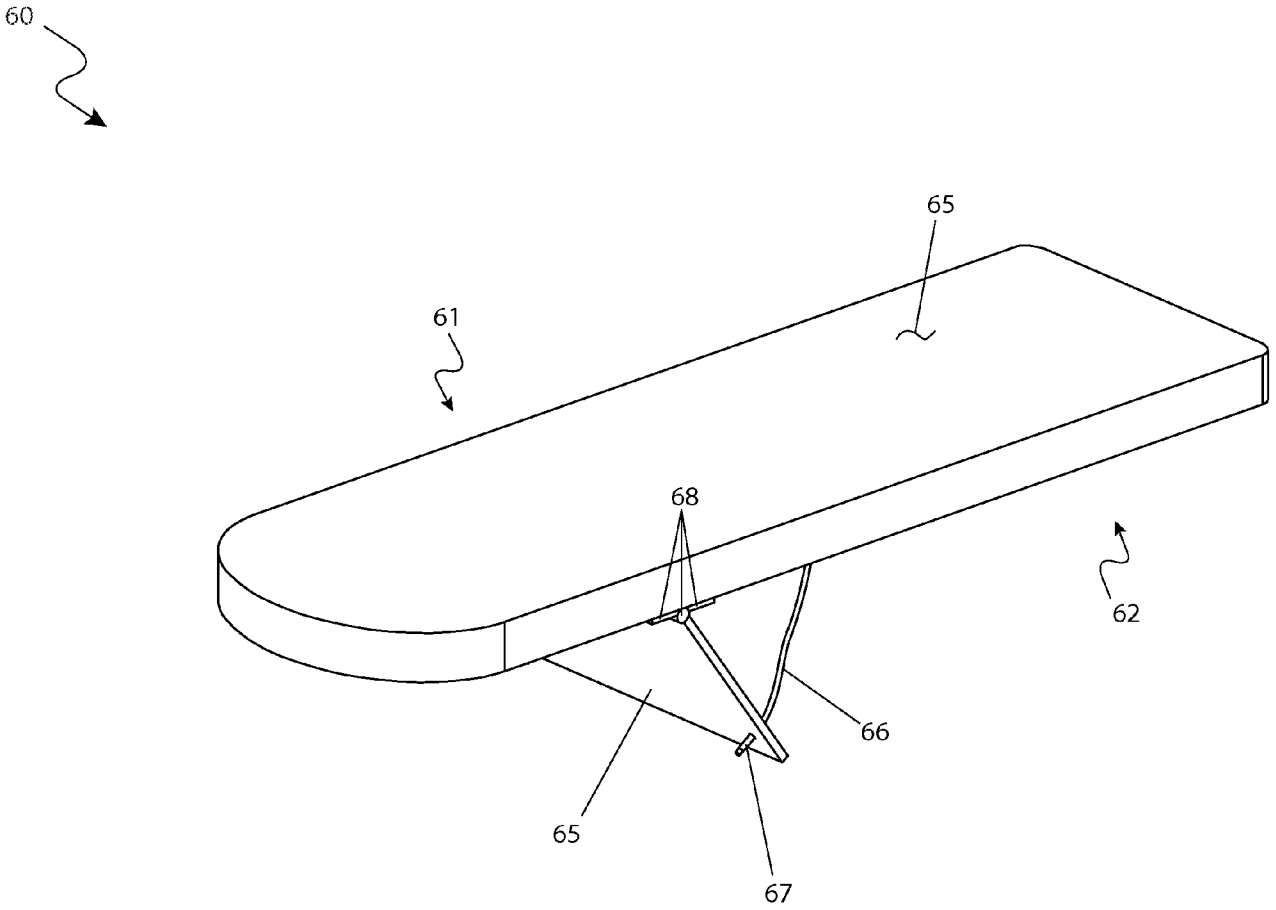
FIG. 7 is a top perspective view of the alternate hinging embodiment 60, according to yet another alternate embodiment of the present invention; and, FIG. 8 is a cross-sectional view of the alternate hinging embodiment 60 taken along line A-A (as shown in FIG. 7), according to yet another alternate embodiment of the present invention.
Figure 8:
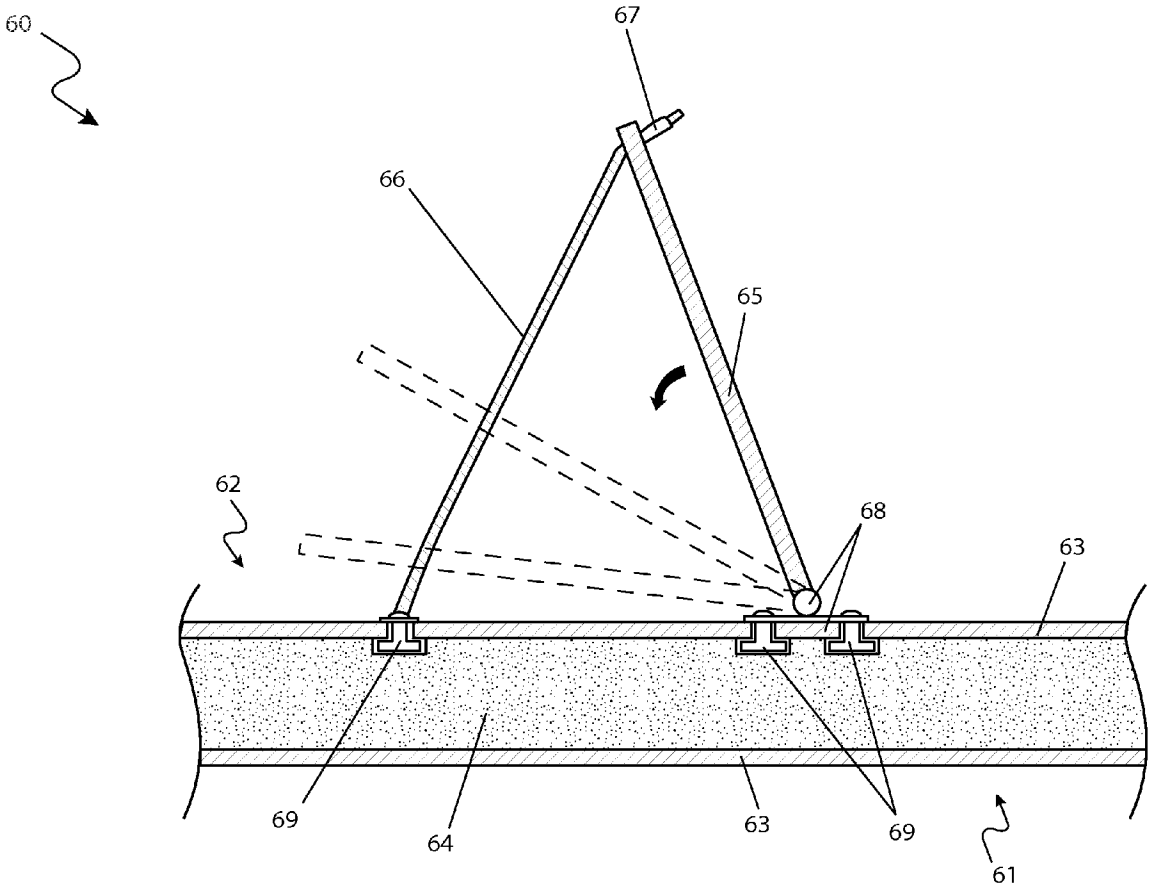

Referring now to FIG. 6, is a bottom perspective view of an alternate hinging embodiment 60, FIG. 7, a top perspective view of the alternate hinging embodiment 60, and FIG. 8, a cross-sectional view of the alternate hinging embodiment 60 taken along line A-A (as shown in FIG. 7), according to the preferred embodiment of the present invention, are disclosed. The device 10 may also comprise an alternate hinging embodiment 60 further comprising a hinging fin 65 which is utilized to catch the turbulent water 95 to drive said alternate hinging embodiment 60 in a desired forward direction. The alternate hinging embodiment 60 also comprises a hinge embodiment deck 61 for a rider 90 to operate said alternate hinging embodiment 60, a hinge embodiment bottom surface 62 which provides a surface area to affix the hinging fin 65, a hinge embodiment exterior surface 63 which is similar to the abovementioned preferred exterior 27, and a hinge embodiment core 64 which provides a buoyant and sturdy portion to hold the rider 90 and affix the hinging fin 65.

The hinge 61 is fastened widthwise to the bottom surface 30 at an intermediate location with a common hinge 68. The hinge 68 is attached to the hinge embodiment core 64 with integrally molded or adhered "T"-shaped studs 69. The hinging fin 65 is preferably integral to the hinge 68 and is oriented across the entire length of said hinge 68. The hinging fin 65 comprises a rectangular body and fabricated from a plastic or metal material. The hinging fin 65 is prohibited from rotating past a ninety degree (90°) angle by a pair of stabilizing cords 66. The stabilizing cords 66 assist in holding the hinging fin 65 to less than the ninety degree (90°) angle as turbulent water 95 is forced against an exterior surface of said hinging fin 65 which concurrently drives alternate hinging embodiment 60. The stabilizing cords 66 are fabricated from a nylon material, yet other materials may be utilized without limiting the scope of the alternate hinging embodiment 60. The stabilizing cords 66 are attached into the hinge embodiment core 64 via studs 69 which are mentioned herein above. The stabilizing cords 66 are also attached to an upper portion of the hinging fin 65 with a common crimp 67 mechanism. The stabilizing cords 66 are positioned through the hinging fin 65 and secured to an opposing side of said hinging fin 65 with the crimp 67 which secured the stabilizing cords 66 to said hinging fin 65.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 3.

The method of utilizing the device 10 may be achieved by performing the following steps: acquiring the device 10; positioning the device 10 onto a desired body of water with the bottom surface 30 and fins 40, 42 in said water; positioning rider 90 parallel with the deck 20 and allowing said rider 90 to lie upon said deck 20; allowing said rider 90 to paddle to a desired area where waves are breaking and creating turbulent water 95; enabling the fins 40, 42 to catch the turbulent water 95 within the curls 41, 43 and propel the device 10 forward; utilizing the device 10 in a conventional manner; and, moving faster in the turbulent water 95 and with more control thus increasing fun for all.

The alternate dual fin embodiment 50 of the present invention can be utilized by the common user in a simple and effortless manner with little or no training. After initial purchase or acquisition of the device 10, it would be installed as indicated in FIGS. 4 and 5.

The method of utilizing the alternate dual fin embodiment 50 may be achieved by performing the following steps: acquiring the alternate dual fin embodiment 50; positioning the alternate dual fin embodiment 50 into a desired body of water with the alternate dual fin bottom surface 52 and dual fins 54, 56 within said water; positioning a rider 90 on the alternate dual fin deck 51; enabling the dual fins 54, 56 to catch the turbulent water 95 within the dual fin curls 55, 57 to propel the alternate dual fin embodiment 50 forward; utilizing the alternate dual fin embodiment 50 in a conventional manner; and, moving faster in the water and with more control thus increasing fun for all.

The alternate hinging embodiment 60 of the present invention can be utilized by the common user in a simple and effortless manner with little or no training. After initial purchase or acquisition of the device 10, it would be installed as indicated in FIGS. 6 through 8.

The method of utilizing the alternate hinging embodiment 60 may be achieved by performing the following steps: acquiring the alternate hinging embodiment 60; positioning the alternate hinging embodiment 60 onto a desired body of water with the hinge embodiment bottom surface 62 and hinging fin 65 within said water; positioning a rider 90 on the hinge embodiment deck 61; paddling the alternate hinging embodiment 60 to a location within the water where waves are breaking and enabling the hinging fin 65 to catch turbulent water 95 which rotates said hinging fin 65 and extends each hinge stabilizer 66 to propel the alternate hinging embodiment 60 forward; utilizing the alternate hinging embodiment 60 in a conventional manner; and, moving faster in the water and with more control thus increasing fun for all.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A water sport riding board, comprising:

a core, formed of a resilient, flexible, and buoyant material, further comprising a deck surface and an underside surface, a tail portion at an aft location, and a nose portion at a fore location;

an upper fin located at said nose portion of said underside surface and spanning an entire width of said core, said upper fin comprising an extension of said nose portion and extending downward and terminating in a rearwardly configured upper curl;

a lower fin located at an intermediate portion of said underside surface parallel to said upper fin and spanning an entire width of said core, said lower fin extending downward and terminating in a rearwardly configured lower curl; and, at least one fin affixed to said underside surface and depending downward therefrom;

wherein said at least one fin enables water to provide a turbulent force to result in propelling said riding board through a body of water; and, wherein said upper curl and said lower curl produces said turbulent force.

2. The riding board of claim 1, wherein said core comprises generally an overall tombstone shape.

3. The riding board of claim 1, wherein said core comprises foam.

4. The riding board of claim 1, wherein an exterior surface of said core further comprises nylon, a bonded material, or a coated material.

5. The riding board of claim 1, wherein said at least one fin is an integrally formed feature of said core.

6. The riding board of claim 1, wherein said upper fin and said lower fin each comprises a generally wave-shaped member.

7. The riding board of claim 1, further comprising:

an upper fin located at said nose portion of said underside surface and spanning an entire width of said core, said upper fin comprising an extension of said nose portion and extending downward and terminating in a rearwardly configured bifurcated upper dual fin arrangement, thereby defining a pair of upper curls; and, a lower fin located at an intermediate portion of said underside surface parallel to said upper fin and spanning an entire width of said core, said lower fin extending downward and terminating in a rearwardly configured bifurcated lower dual fin arrangement, thereby defining a pair of lower curls;

wherein said pair of upper curls and said pair of lower curls produces said turbulent force.

8. The riding board of claim 7, wherein each fin of said upper dual fin arrangement and each fin of said lower dual fin arrangement terminates in a generally tapering edge.

9. A water sport riding board, comprising:

a core, formed of a resilient, flexible, and buoyant material, further comprising a deck surface and an underside surface, a tail portion at an aft location, and a nose portion at a fore location;

a fin having a proximal end hingedly affixed to an intermediate location of said underside surface with a hinge; and, a pair of stabilizing cords each having a first end affixed to said underside surface rearwardly of said hinge and a second end affixed to a distal end of said fin;

wherein said fin enables water to provide a turbulent force to result in propelling said riding board through a body of water;

wherein said hinge and said fin further comprise a unitary structure having a width spanning a width of said core;

wherein said hinge is fastened to said underside surface of said core via a plurality of studs;

wherein said fin is selectively manipulated incrementally to a desired angle between a fully retracted position laying flat and parallel against said underside surface and a fully deployed position; and, wherein said pair of stabilizing cords limits travel of said fin past said fully deployed position.

10. The riding board of claim 9, wherein said core comprises generally an overall tombstone shape.

11. The riding board of claim 9, wherein said core comprises foam.

12. The riding board of claim 9, wherein an exterior surface of said core further comprises nylon, a bonded material, or a coated material.

13. The riding board of claim 9, wherein said pair of stabilizing cords limit travel of said fin past a 90° angle of said fin relative to said underside surface of said core.

14. The riding board of claim 9, wherein said fin further comprises a metallic or plastic construction.

15. The riding board of claim 9, wherein said plurality of studs are integral to or bonded to said core.

16. The riding board of claim 9, wherein said fin further comprises a metallic or plastic construction.

17. The riding board of claim 9, wherein said pair of stabilizing cords limit travel of said fin past a 90° angle of said fin relative to said underside surface of said core.

18. The riding board of claim 17, wherein said fin further comprises a metallic or plastic construction.

* * * * *